US005297350A

United States Patent [19]

Stampacchia et al.

[11] Patent Number: 5,297,350

[45] Date of Patent: Mar. 29, 1994

[54] REAR-ENTRY SKI BOOT

[75] Inventors: Marcello Stampacchia, Treviso; Sergio Cavaliere, Istrana, both of Italy

[73] Assignee: Lange International S.A., Fribourg, Switzerland

[21] Appl. No.: 803,795

[22] Filed: Dec. 6, 1991

Related U.S. Application Data

[63] Continuation of Ser. No. 583,603, Sep. 17, 1990, abandoned.

[30] Foreign Application Priority Data

Oct. 6, 1989 [CH] Switzerland ..... 3656/89-2

[51] Int. Cl.[5] ..... A43B 5/04

[52] U.S. Cl. ..... 36/120; 36/117

[58] Field of Search ..... 36/117, 118, 119, 120, 36/121

[56] References Cited

U.S. PATENT DOCUMENTS

| | | | |
|---|---|---|---|
| 4,282,658 | 8/1981 | Hanson et al. | 36/121 |
| 4,381,613 | 5/1983 | Lederer | 36/121 |
| 4,601,118 | 7/1986 | Zanatta | 36/121 X |
| 4,694,593 | 9/1987 | Petrini et al. | 36/121 X |
| 4,769,930 | 9/1988 | Morell et al. | 36/120 X |
| 4,793,076 | 12/1988 | Hilgarth | 36/120 X |
| 4,916,835 | 4/1990 | Begey et al. | 36/120 X |

FOREIGN PATENT DOCUMENTS

| | | | |
|---|---|---|---|
| 3400089 | 8/1984 | Fed. Rep. of Germany | 36/117 |
| 3618923 | 12/1986 | Fed. Rep. of Germany | 36/121 |
| 2539278 | 7/1984 | France | 36/121 |

*Primary Examiner*—Paul T. Sewell
*Assistant Examiner*—Beth Anne Cicconi
*Attorney, Agent, or Firm*—Kane, Dalsimer, Sullivan, Kurucz, Levy, Eisele & Richard

[57] ABSTRACT

The rear-entry boot consists of, in the area of one of the articulations (4), interacting components which make it possible to modify the position of the articulation of the shaft (2, 3) in relation to the shell (1). It comprises a piece (6) in the form of a small arch which extends over the instep, this piece having a profile (7) which interacts with a mating profile (8) of the front part (2) of the shaft, so that these profiles remain engaged in one another whatever the lateral inclination of the shaft in relation to the shell.

5 Claims, 3 Drawing Sheets

FIG. 1
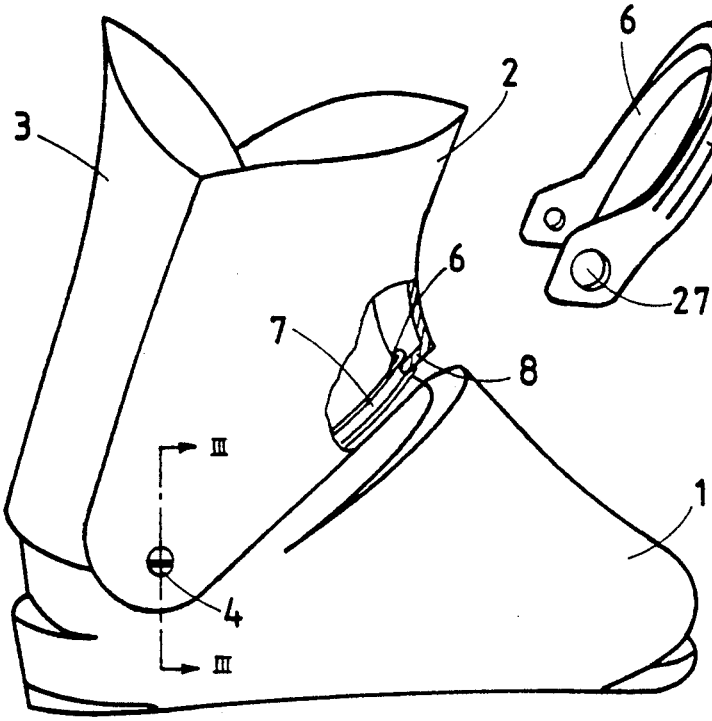
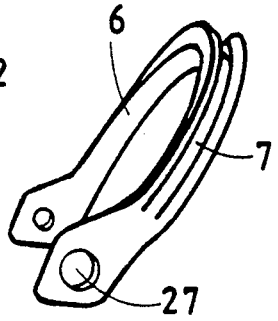
FIG. 2
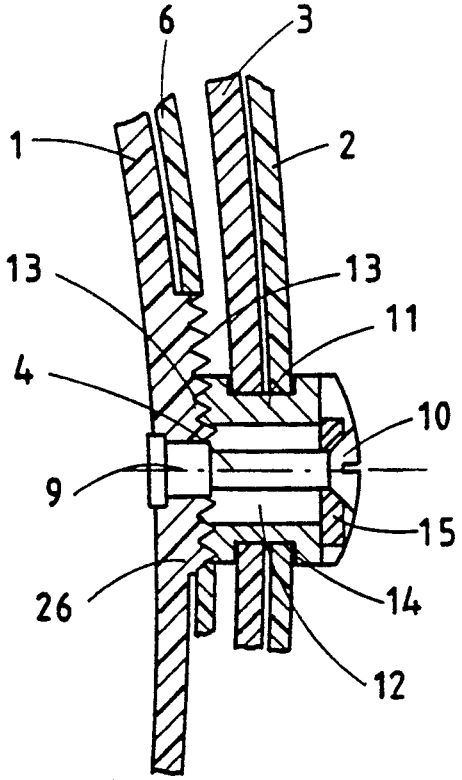
FIG. 3

FIG. 4
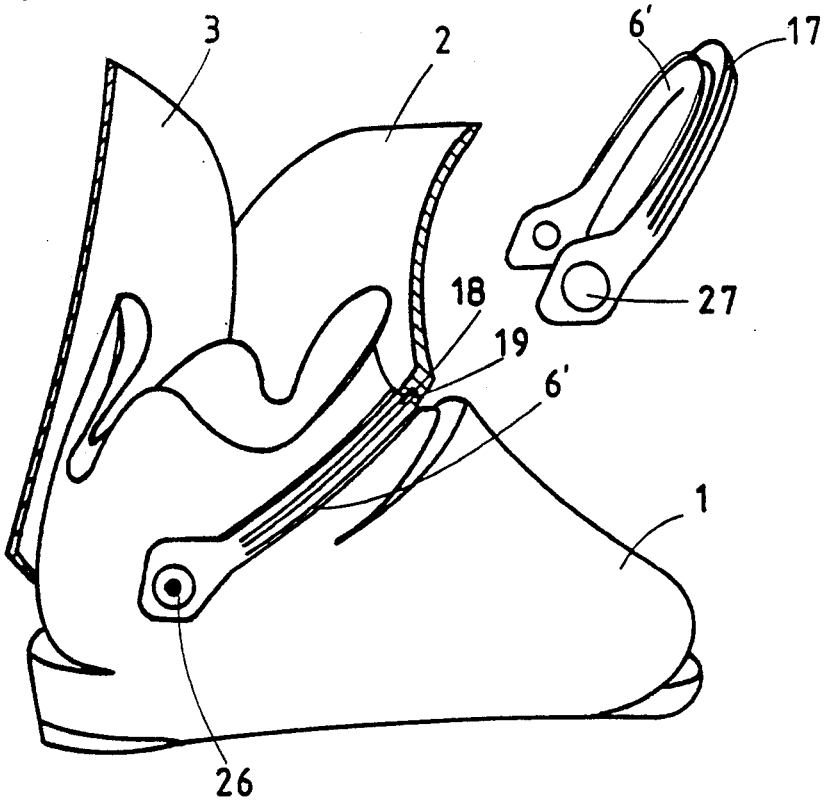
FIG. 5
FIG. 6
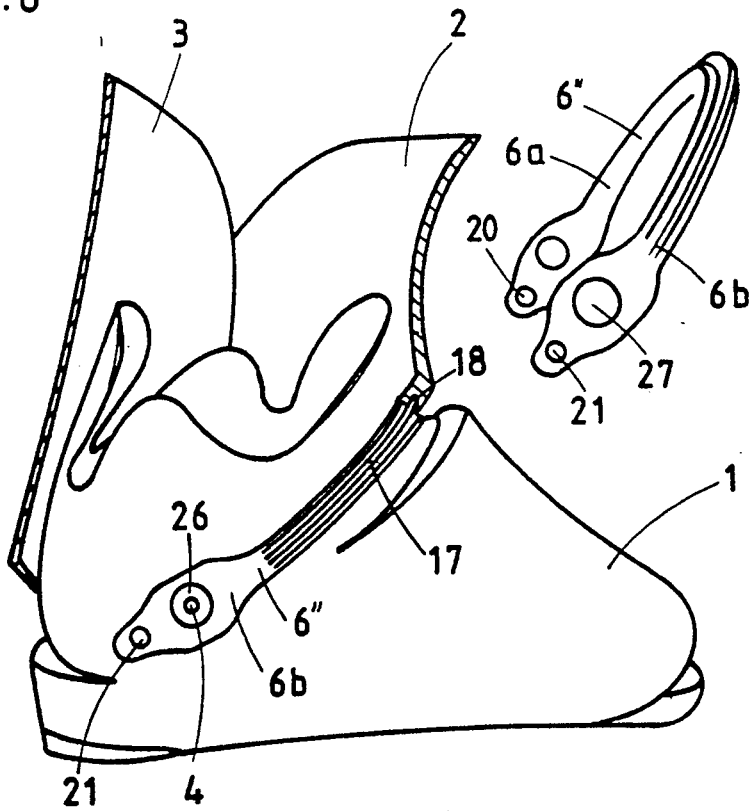
FIG. 7

FIG.8
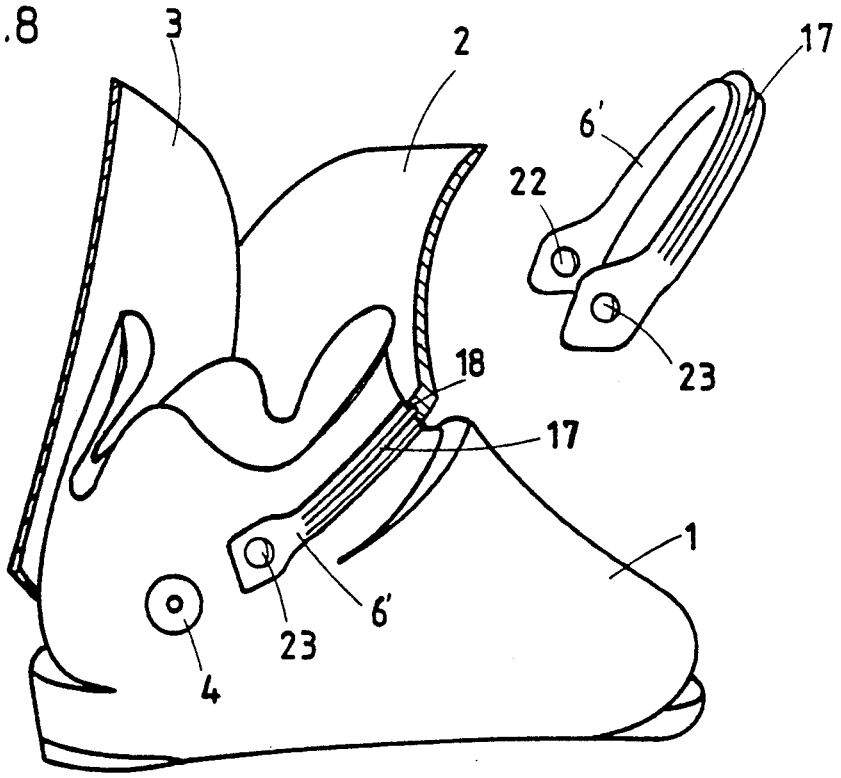
FIG. 9
FIG. 10
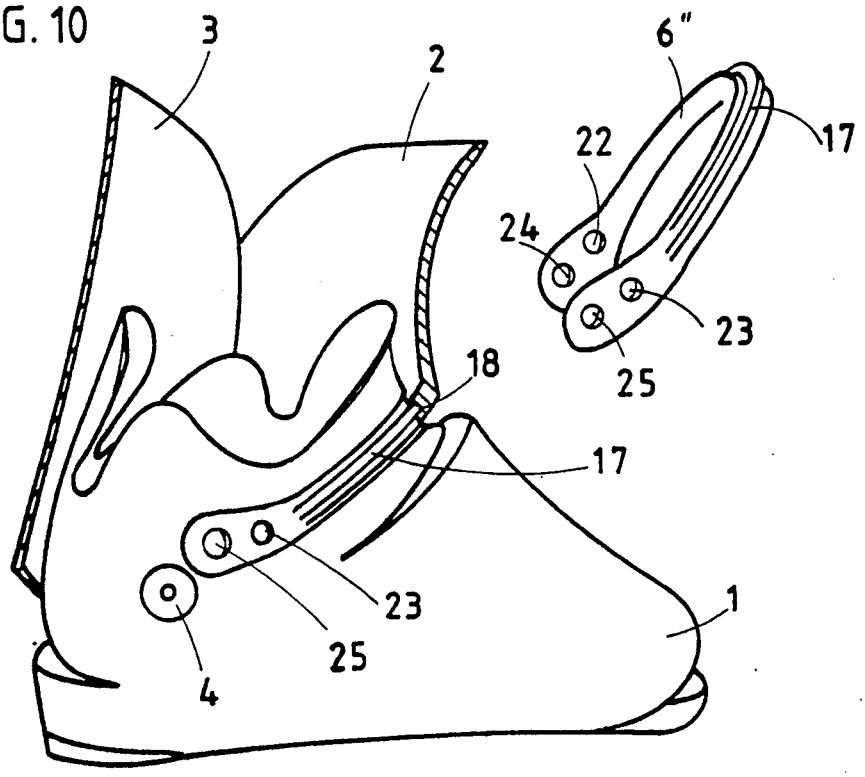
FIG. 11

REAR-ENTRY SKI BOOT

This is a continuation of copending application Ser. No. 07/583,603, filed on Sep. 17, 1990, now abandoned.

FIELD OF THE INVENTION

The present invention relates to a rear-entry boot consisting of a shell surrounding the foot and the heel and of a shaft in two parts, front and rear respectively, the rear part of which is articulated on the shell about two pins, and in which the lateral inclination of the shaft in relation to the shell can be modified.

PRIOR ART

Such a boot is known from the patent FR 2 617 380. In this boot, the front part of the shaft is formed in one piece with the shell, so that only the lateral inclination of the rear part of the shaft can be modified. This solution is consequently not satisfactory.

From the U.S. Pat. Nos. 4,334,368 and 4,601,118, boots are known furthermore, the shaft of which, in one piece and articulated on the shell, has means which make it possible to modify the position of the shaft in relation to one of the articulation pins, so as to modify the lateral inclination of the shaft.

This latter solution can be used on a rear-entry boot, the two parts of the shaft of which are articulated on the shell, but when the shaft is raised in relation to the articulation pin, the lower edge of the front part of the shaft moves away from the shell, the opening thus formed allowing water and snow to penetrate and giving an impression of poor finishing of the boot, not to mention the unsatisfactory aesthetic effect.

SUMMARY OF THE INVENTION

The aim of the present invention is to produce a rear-entry ski boot with a shaft made of two parts of adjustable lateral inclination, preventing the abovementioned fault.

The ski boot according to the invention is a ski boot wherein the front part of the shaft is also articulated about the same pins as the rear part and wherein the boot comprises a piece in the form of a small arch which extends over the instep between the shell and the front part of the shaft and which has a profile which interacts with a mating profile of the front part of the shaft, these mating profiles being engaged in one another in such a manner that they remain engaged whatever the inclination of the shaft in relation to the shell, within the adjustment range of this inclination.

The front part of the shaft can thus move away slightly from the shell without breaking the joint and the continuity between this front part of the shaft and the shell.

It is moreover possible to use the piece in the form of a small arch as an element of elastic bending in order to ensure the elasticity of the shaft when bending forward, by fixing the piece in the form of a small arch to the shell at at least a third point situated in the vicinity of one of the points of fixing of the small arch to the shell, preferably at two opposite points on each side of the shell. The position of these fixing points can itself be adjustable, which makes it possible to adjust the resistance to bending.

The pins of articulation of the shaft on the shell can be used for the retention of the small arch on the shell.

BRIEF DESCRIPTION OF THE DRAWINGS

The attached drawing shows, by way of example, a number of embodiments of the boot according to the invention.

FIG. 1 shows a boot, the shaft of which has been cut vertically along the center plane of the boot, according to a first embodiment.

FIG. 2 shows the small arch of this first embodiment.

FIG. 3 is a partial cross-sectional view along III—III of FIG. 1.

FIGS. 4 and 5 show an alternative embodiment of the first embodiment.

FIGS. 6 and 7 show a second alternative embodiment.

FIG. 8 is a view analogous to that in FIG. 1 showing a boot according to a second embodiment.

FIG. 9 shows the small arch of this second embodiment.

FIGS. 10 and 11 show an alternative of the second embodiment.

DESCRIPTION OF THE PREFERRED EMBODIMENTS

The boot shown in FIG. 1 comprises a shell 1 made of synthetic material, in the form of a clog surrounding the foot and the heel, and a shaft consisting of a front part 2 and of a rear part 3, both articulated on the shell 1, on each side of the latter, by means of two pins 4 and 5, the pin 5 consisting simply of a rivet. On that part of the shell which extends over the instep, a piece 6 in the form of a small arch extends, which is also made of synthetic material and retained on the shell 1 by the articulation pins 4 and 5 of the shaft. This small arch 6 has a profile 7 in the form of a groove which extends along the entirety of the small arch. The lower edge of the front part of the shaft 2 has an elbowed part 8 which engages in the groove 7, the width of which corresponds to the thickness of the elbowed edge 8. The groove 7 and the elbowed edge 8 thus constitute mating profiles.

The articulation pin 4 is in two parts, namely a threaded tubular part 9 and a screw 10 screwed into the part 9.

The pin passes through a pivot 11 which has an oblong passage 12 which is directed essentially vertically and that face of which which is turned towards the shell 1 is provided with a transverse toothing 13 which is directed perpendicularly to the direction of the oblong hole 12. The pivot 11 has a circular cylindrical groove 14 which serves as the actual pivot for the parts 2 and 3 of the shaft.

The piece in the form of a small arch 6 is gripped between the pivot 11 and the shell 1. The pivot 11 is retained by the screw 10 by means of a washer 15.

The oblong hole 12 makes it possible to displace the pivot 11 vertically in relation to the pin 4, that is to say to modify the lateral inclination or canting of the shaft in relation to the shell 1. The piece in the form of a small arch 6, however, remains applied to the shell 1. Vertical displacement of the pivot 11 has the effect of raising the front part 2 of the shaft but, at the time of this displacement, the elbowed edge 8 of the front part 2 of the shaft remains permanently engaged in the groove 7 of the piece 6, thus maintaining the impermeability of the boot in the area of the instep and maintaining the continuity of the boot in aesthetic terms.

When the shaft is bent forwards, the piece 6 in the form of a small arch follows the front part 2 of the shaft, pivoting about the pins 4 and 5.

The surfaces facing the pivot 11 and the washer 15 also have a toothing 16.

The mating profiles of the piece in the form of a small arch 6 and of the front part of the shaft 2 can be reversed, as shown in FIGS. 4 and 5, in which the modified front part of the shaft is indicated by 2' and the modified piece in the form of a small arch is indicated by 6'. The piece in the form of a small arch 6' has a rib 17 which engages in a groove 18 formed in an excess thickness 19 of the edge of the front part 2' of the shaft. As far as the rest is concerned, this alternative embodiment is identical to the first embodiment The pieces in the form of a small arch 6 and 6' can be used as an element of elasticity, ensuring a controlled elasticity of the shaft when bending To this end, the piece in the form of a small arch is fixed to the shell at at least a third point. An illustrative embodiment is shown in FIGS. 6 and 7, in which the piece in the form of a small arch 6'', of a similar profile to the piece 6', is fixed to the shell at two other points 20 and 21 situated on extensions of the piece 6'' beyond the articulations of the shaft. When the skier bends his/her leg, the piece 6'' works by bending in the areas 6A and 6B.

The piece in the form of a small arch does not necessarily have to be passed through by the articulation pins of the shaft. FIGS. 8 and 9 show a second embodiment, in which the small arch 6' is fixed to the shell by way of two points 22 and 23 situated above the articulation pins of the shaft, in the direction of the instep.

The piece in the form of a small arch of this second embodiment can also be used for control of the bending of the shaft. This alternative embodiment is shown in FIGS. 10 and 11. The piece in the form of a small arch 6'' is fixed to the shell at two additional points 24, 25 situated above the pins of articulation of the shaft on the shell.

One of the pairs of points of fixing of the small arch to the shell could be adjustable, so as to modify the resistance of the piece 6 to bending.

We claim:

1. A rear-entry ski boot comprised of a shell (1) surrounding the foot and the heel and of a shaft in two parts, a front part (2) and a rear part (3) respectively, the front part and rear part (3) being articulated on the shell about two pins comprising principle fixing points, and in which a lateral inclination of the shaft in relation to the shell can be modified in an adjustment range, and wherein the boot comprises a piece (6; 6'; 6'') in the form of a small arch attached to the shell and extending over the instep between the shell and the front part of the shaft, the small arch being a unitary piece having a mating profile (7; 17) which interacts with an opposite mating profile (8; 18) on the front part (2) of the shaft, the mating profile and opposite mating profile being a combination of an edge and a groove adapted to receive the edge the mating profile and opposite mating profile being engaged with one another in such a manner that they remain engaged independent of the lateral inclination of the shaft in relation to the shell, within the adjustment range of the lateral inclination of the shaft, wherein the modification of the lateral inclination of the shaft comprise a pivot (11) which passes through the two parts of the shaft and has an oblong hole (12) which is passed through by the articulation pin (4) and makes it possible to displace the pivot perpendicularly to the articulation pin in order to modify the lateral inclination of the shaft, wherein the piece in the form of a small arch (6; 6') is gripped between the pivot and the shell.

2. The ski boot as claimed in claim 1, wherein the piece in the form of small arch (6) has a longitudinal groove (7), in which a lower elbowed edge (8) of the front part of the shaft is engaged.

3. The ski boot as claimed in claim 1, wherein the piece in the form of small arch (6') has a longitudinal rib (17) engaged in a groove (18) of the front part of the shaft.

4. The ski boot as claimed in claim 1, wherein the piece in the form of small arch is passed through by the articulation pins (4, 5) of the shaft.

5. The ski boot as claimed in claim 1, wherein the piece in the form of small arch is moreover fixed to the shell at (20, 21; 24, 25) situated in the vicinity of one of the principal fixing points.

* * * * *